US006785644B2

(12) United States Patent
Koyanagi

(10) Patent No.: US 6,785,644 B2
(45) Date of Patent: Aug. 31, 2004

(54) ALTERNATE WINDOW COMPRESSION/ DECOMPRESSION METHOD, APPARATUS, AND SYSTEM

(75) Inventor: Yukio Koyanagi, Saitama (JP)

(73) Assignee: Yasue Sakai, Saitama (JP)

( * ) Notice: Subject to any disclaimer, the term of this patent is extended or adjusted under 35 U.S.C. 154(b) by 0 days.

(21) Appl. No.: 10/319,466

(22) Filed: Dec. 16, 2002

(65) Prior Publication Data

US 2003/0088404 A1 May 8, 2003

Related U.S. Application Data

(63) Continuation of application No. PCT/JP02/03621, filed on Apr. 11, 2002.

(30) Foreign Application Priority Data

Apr. 16, 2001 (JP) ..... 2001-116420

(51) Int. Cl.[7] ..... G10L 11/06; G10L 19/14; G10L 21/04

(52) U.S. Cl. ..... 704/215; 704/205; 704/210; 704/501

(58) Field of Search ..... 704/215, 211–213, 704/219, 230, 205, 210, 501

(56) References Cited

U.S. PATENT DOCUMENTS

| | | | | |
|---|---|---|---|---|
| 4,428,063 A | * | 1/1984 | Fourcade | 713/501 |
| 4,890,325 A | | 12/1989 | Taniguchi et al. | |
| 5,222,189 A | * | 6/1993 | Fielder | 704/230 |
| 2003/0133505 A1 | | 7/2003 | Koyanagi | |

FOREIGN PATENT DOCUMENTS

| | | | |
|---|---|---|---|
| JP | 59-096513 | A1 | 6/1984 |
| JP | 03-192400 | A1 | 8/1991 |
| JP | 04-061509 | A1 | 2/1992 |
| JP | 05265489 | | 10/1993 |
| JP | 06282296 | | 10/1994 |
| JP | 07023020 | | 1/1995 |
| JP | 08095599 | | 4/1996 |
| JP | 10-126275 | A1 | 5/1998 |
| JP | 2000132194 | | 5/2000 |
| JP | 2000181452 | | 6/2000 |
| JP | 2000200100 | | 7/2000 |
| JP | 2001084000 | | 3/2001 |
| JP | 2001-136073 | A1 | 5/2001 |
| WO | WO 01/95496 | A1 | 12/2001 |

* cited by examiner

*Primary Examiner*—Richemond Dorvil
*Assistant Examiner*—Daniel Nolan
(74) *Attorney, Agent, or Firm*—Connolly Bove Lodge & Hutz LLP; Larry J. Hume

(57) ABSTRACT

With respect to data having periodicity to be compressed, windows of the same size are set for every two sections according to an interval of peaks appearing substantially periodically and processing for sorting sample data alternately among the set windows of the same size is sequentially performed, whereby a frequency of data having periodicity is replaced with an approximately half frequency without damaging reproducibility to original data at all to make it possible to apply compression processing to data of the replaced low frequency. If this sorting processing is applied to compression processing having a characteristic that a compression ratio is not increased in a high-frequency region, it becomes possible to improve a compression ratio without damaging a quality of reproduced data by decompression at all.

36 Claims, 5 Drawing Sheets

HUMAN VOICE DATA

DATA AFTER SORTING

BETWEEN D1 TO D7

BETWEEN D1 TO D6

ALTERNATE WINDOW COMPRESSION/ DECOMPRESSION METHOD, APPARATUS, AND SYSTEM

CROSS-REFERENCE TO RELATED APPLICATIONS

This application is a continuation application claiming benefit under 35 U.S.C. §120 from co-pending International Application PCT/JP02/03621, filed on Apr. 11, 2002 by Yukio Kovanagi, which also claims priority under 35 U.S.C. §119 to Japanese Application JP 2001-116420 filed on Apr. 16, 2001 by Yukio Kovanagi.

BACKGROUND OF THE INVENTION

1. Field of the Invention

The present invention relates to a compression method and device, a decompression method and device, a compression/decompression system, a peak detection method, program and a recording medium and, in particular, to a compression and decompression system of continuous analog signals or digital signals.

2. Description of the Related Art

Conventionally, in case of transmitting or accumulating a signal with a large amount of information such as an image signal or a voice signal, the signal is compressed and decompressed for the purpose of reducing an amount of transmitted information and extending savable time in an accumulating medium. In general, in case of compressing an analog signal, first, the analog signal is sampled in accordance with a predetermined sampling frequency to be digitized, and obtained digital data is subjected to compression processing.

For example, in compression of an image signal or a voice signal, a method of performing compression in a frequency area after processing original data using a conversion filter of time axis—frequency axis such as DCT (Discrete-Cosine-Transform). DPCM (Differential Pulse Code Modulation) often used in a telephone line as a compression system of a voice signal is also used aiming at this point. Further, this compression system by DPCM is a system for coding a differential of neighboring sample values when a waveform is sampled.

In addition, as a system for performing time/frequency conversion, there is also a system using a sub-band filter or MDCT (Modified Discrete Cosine Transform). There is an MPEG (Moving Picture Image Coding Experts Group) audio such as MP3 or AAC as a coding system using such a system. Recently, compression systems such as ATRAC (Adaptive Transform Acoustic Coding), TwinVQ, WMA (Windows Media Audio) and Dolby Digital® (AC-3) have been widely used.

In addition, a compression system of an image most widely used is generally known as this MPEG standard as well.

Decompression processing of data compressed in accordance with the above-described compression system is basically performed by an opposite operation of the compression processing of the same compression system.

That is, compressed digital data is subjected to predetermined decompression processing after being converted from a signal of a frequency area to a signal of a time area by means of frequency-to-time conversion, whereby original digital data is reproduced. Then, the original data found in this way is digital-analog converted according to necessity and outputted as an analog signal.

In general, in considering compression and decompression of data, it is an important subject to find how to improve a quality of reproduced data while increasing a compression ratio. However, in the above-described conventional compression/decompression system, there is a problem in that, when it is attempted to increase a compression ratio of an image signal or a voice signal, a quality of an image or a voice that is reproduced by decompressing compression data is deteriorated and, conversely, when importance is attached to a quality of a reproduced image or a reproduced voice, a compression ratio of an image signal or a voice signal decreases. Thus, it is extremely difficult to realize both improvement of a compression ratio and improvement of a quality of reproduced data.

In addition, in the above-described conventional compression/decompression system, since a signal on a time axis is converted to a signal on a frequency axis to be compressed, processing such as time/frequency conversion in compression and frequency/time conversion in decompression becomes necessary. Thus, there is a problem in that processing becomes complicated and, at the same time, a structure for realizing this becomes extremely complicated. This is a factor for extending a processing time required for compression and decompression and making miniaturization of an apparatus difficult.

The present invention has been devised in order to solve such problems, and it is an object of the present invention to provide a completely new compression/decompression system that realizes both improvement of a compression ratio and improvement of a quality of reproduced data.

In addition, it is another object of the present invention to make it possible to simplify compression/decompression processing of signals to reduce processing time and, at the same time, also simplify a configuration for realizing this.

SUMMARY OF THE INVENTION

In order to solve the above-described subject, in a compression side of the present invention, with respect to data having periodicity to be compressed, windows of the same size are set for every plurality of sections according to a period of the data, processing for sorting sample data alternately among the set windows of the same size is sequentially performed, and compression processing is applied to data obtained by the sorting processing, whereby compression data is obtained.

In addition, on a decompression side of the present invention, decompression processing opposite to the compression processing is applied to the compression data, the same windows as described above are set for data obtained by the decompression processing, and processing for resorting data alternately among the set windows of the same size is sequentially performed, whereby decompression data is obtained.

In addition, in a peak detection method of the present invention, with respect to data having periodicity in which peaks appear substantially periodically, a maximum value of data in a first section existing before a certain sampling point inclusive (pre-maximum value) and a maximum value of data in a second section existing after the above-mentioned sampling point inclusive (post-maximum value) are detected and, if a data value of the above-mentioned sampling point, the above-mentioned pre-maximum value and the above-mentioned post-maximum value are coincide with each other, the above-mentioned sampling point is detected as a peak.

Since the present invention consists of the above-mentioned technical means, a frequency of data having periodicity is replaced with a lower frequency by the sorting processing, and the compression processing is applied to the replaced data. The sorting processing has no loss at all because an order of data is simply sorted and has 100% reproducibility. Therefore, in particular, the present invention is preferably applied to compression processing having a characteristic that a compression ratio is not increased when a high-frequency signal is compressed. In addition, it becomes possible to increase a compression ratio without damaging reproducibility to original data at all even if the compression processing is not changed as it is.

In another aspect of the present invention, as an example of the above-mentioned compression processing, processing is performed in which sampling points where, after performing the above-described sorting processing, when data between two sampling points is subjected to linear interpolation with respect to data obtained by the sorting processing, an error between interpolated data and original data is up to a desired value are sequentially detected as sample points of compression data.

In this case, a large number of sample data included in the sorted data have sample points where a small error between interpolated data and original data is detected, even if simple linear interpolation is performed at the time of decompression processing. Then, only discrete amplitude data in each sample point, timing data representing a time interval between respective sampling points, and the like are generated as compression data. Thus, it becomes possible to realize a high compression ratio while favorably maintaining reproducibility of original data by decompression.

In particular, according to the present invention, even if data with a high frequency, that is, data in which a data value changes relatively largely even in adjacent sampling points is compressed, the above-described detection processing of sample points is performed after the frequency is lowered by sorting of the data. Thus, it becomes possible to reduce the number of sample points to be detected as much as possible. It also becomes possible to realize a higher compression ratio while maintaining a quality of data to be reproduced by decompression high.

In addition, according to the present invention, when a signal on a time axis is compressed, it becomes possible to apply compression processing to the signal as it is on the time axis without performing time/frequency conversion to apply the compression processing to the signal on a frequency axis. Further, when the data compressed in this way is decompressed, it becomes possible to apply decompression processing to the data as it is on the time axis. In particular, on the decompression side, it becomes possible to reproduce highly precise decompression data that is almost the same as original data before compression simply by performing interpolation processing and extremely simple processing of sorting of data.

In addition, according to the peak detection method of the present invention, even if a data value of a certain sampling point is larger than a data value proximate to it and looks as if it is a peak at a glance, the sampling point is not detected as a peak if a larger data value exists in predetermined sections in front and behind the sampling point. The data value is detected as a peak only when each maximum value in the predetermined sections and a data value of a present sampling point coincide with each other. Consequently, it becomes possible to accurately detect only a true peak having a data value extremely large compared with other peaks with respect to a signal in which a data value has a peak locally while oscillating up and down.

In another aspect of the present invention, a predetermined section in which a post-maximum value is detected is set larger than a predetermined section in which a pre-maximum value is detected. Alternatively, a predetermined section in which a pre-maximum value is detected is set larger than a predetermined section in which a post-maximum value is detected. Consequently, it becomes possible to more accurately detect only a true peak having a data value extremely large compared with other peaks with respect to a signal in which a data value has a peak locally while oscillating up and down.

DETAILED DESCRIPTION OF THE PREFERRED EMBODIMENTS

An embodiment of the present invention will be hereinafter described based on the drawings.

In a compression system of this embodiment, first, in case of inputting an analog signal as a signal to be compressed, the inputted analog signal is A/D converted into digital data. Then, the following processing is applied to the obtained digital data. In addition, in case of inputting digital data as a signal to be compressed, the following processing is directly applied to the digital data.

Figure 1A:
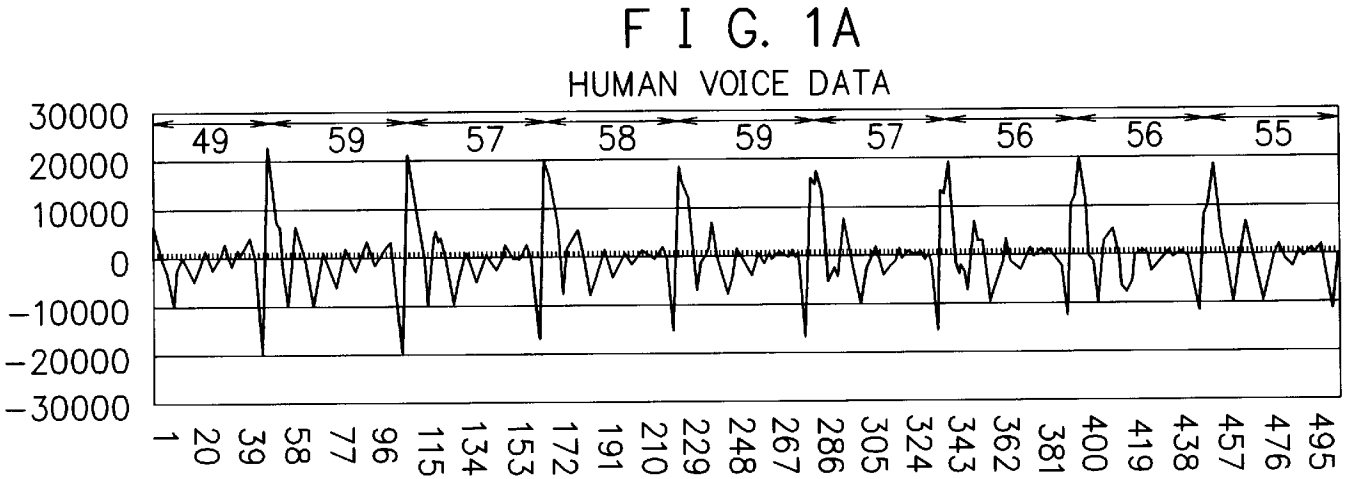
FIGS. 1A and 1B are charts for explaining a basic principle of a compression system according to this embodiment.

FIG. 1A to FIG. 3B are charts for explaining a basic principle of a compression method according to this embodiment. Among these figures, FIGS. 1A and 1B and FIGS. 2A to 2C are charts for explaining a principle of sorting processing. FIG. 1A and FIGS. 2A and 2B show original data to be compressed, and FIG. 1B and FIG. 2C show sorted data.

Figure 1B:
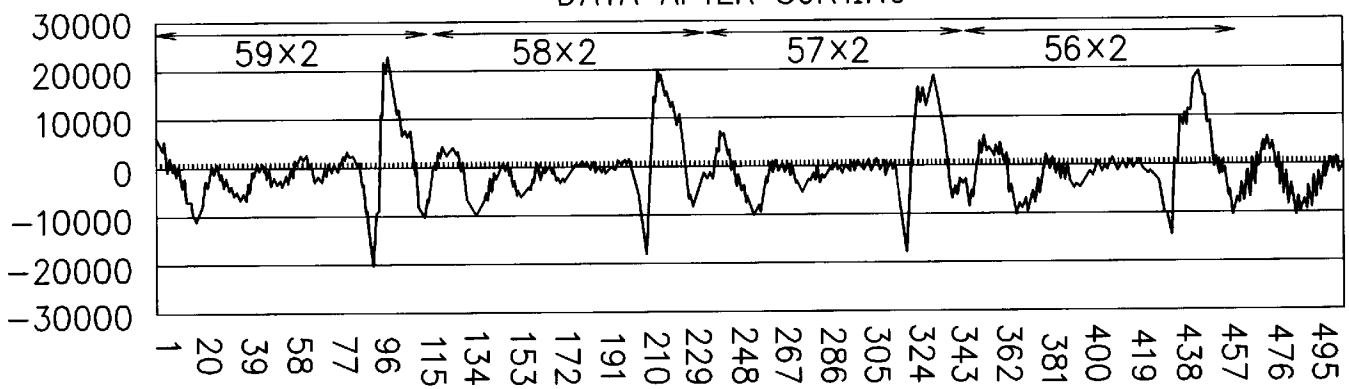

In FIGS. 1A and 1B, the horizontal axis represents time and the vertical axis represents an amplitude of data. The original data of FIG. 1A is voice data that is obtained by sampling a human voice at a frequency of 8 KHz. As shown in FIG. 1A, the human voice is a signal with periodicity in which a data value has a peak locally while oscillating up and down. Note that, in this specification, the peak means a point where a data value is extremely large compared with other sampling points.

In this embodiment, with respect to data having periodicity (in which peaks appear substantially periodically) as shown in FIG. 1A, windows of the same size are set for every two sections according to a period of the data, and processing for sorting sample data alternately between the set two windows is performed sequentially for every two section. Then, compression processing is applied to data obtained by the sorting processing.

A peak appearing substantially periodically is detected, and the above-described windows are set according to an interval of detected peaks. More specifically, every other intervals of a plurality of detected peaks are adopted, and windows of sizes corresponding to the adopted intervals are set for every two sections.

In the example of FIG. 1A, a time interval from first data input to appearing of a first peak (the number of sampling points=the number of clocks) is 49, peak intervals thereafter are 59, 57, 58, 59, 57, 56, 56, 55, and so on. The first interval "49" is not adopted because it does not represent an interval between two peaks, and the next peak interval "59" is adopted as a window width for the first two sections.

Figure 2A:
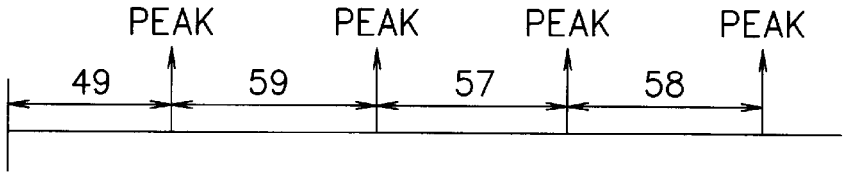
FIGS. 2A to 2C are charts for explaining the basic principle of the compression system according to this embodiment.
Figure 2B:
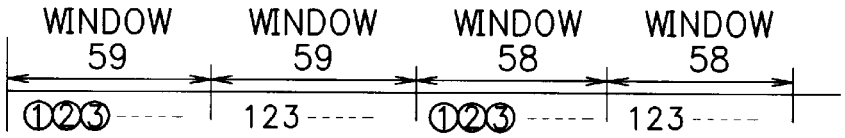

In addition, with respect to the window for the next two sections, the peak interval "58" second from the peak interval adopted first is adopted as a width of the window. FIGS. 2A and 2B shows in detail examples in which the windows having the widths "59" and "58" as described above are set for every two sections.

Figure 2C:
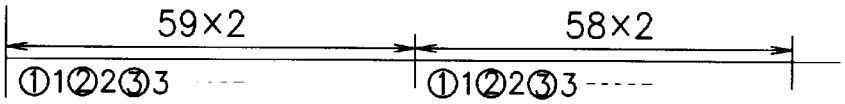

FIG. 2C shows in detail processing for sorting sample data alternately among the windows set in the same size for every two sections as described above. Here, first, in windows of two sections with the width set to "59", sample data of the first window (indicated by numbers with a circle) and sample data of the second window (indicated by numbers without a circle) are sorted alternately (hereinafter referred to as zigzag processing). Next, the same zigzag processing is performed in windows of two sections with the width set to "58".

When the zigzag processing is sequentially performed thereafter for every two sections in the same manner, the original data shown in FIG. 1A is converted as shown in FIG. 1B. The data after sorting shown in FIG. 1B is data in which a frequency of the original data is replaced with an approximately half frequency by the sorting processing.

This sorting processing has no loss at all and has 100% reproducibility because an order of data is simply sorted. Thus, even if the compression processing is applied to data shown in FIG. 1B, reproducibility to the original data is not damaged at all compared with the case in which the compression processing is directly applied to the original data of FIG. 1A.

Therefore, in particular, the sorting processing of this embodiment is applied to compression processing having a characteristic that a compression ratio is not increased when a high-frequency signal is compressed, and the compression processing is executed after a frequency is dropped as shown in FIG. 1B, whereby it becomes possible to increase a compression ratio without damaging reproducibility to the original data at all.

Note that, if a peak interval of original data is not identical over the entire data as shown in FIG. 1A, when every other intervals of a plurality of detected peaks are adopted, and windows of the same size are set for every two sections, an error is generated more or less. For example, if the peak interval "57" is skipped and the next peak interval "58" is adopted to set windows for two sections, the number of sampling points included in the windows for the two sections is increased by one compared with the number of sampling points that should be originally included.

However, this error is not so large. In addition, the error is offset to some extent by plus and minus errors generated for every two sections. For example, if the peak interval "59" next to "58" is skipped and the next peak interval "57" is adopted to set windows for two sections, the number of sampling points included in the windows for the two sections is decreased by two compared with the number of sampling points that should be originally included. Thus, the one more sampling point included in the windows described above is offset. Therefore, accumulated errors are not large over the data as a whole, and the errors do not particularly lead to a problem.

Figure 3A:
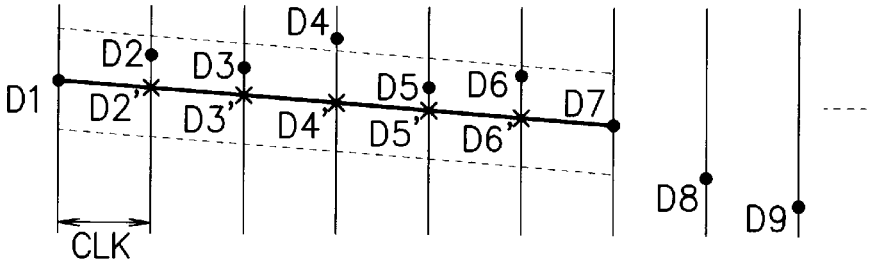
FIGS. 3A and 3B are charts for explaining the basic principle of the compression system according to this embodiment.
Figure 3B:
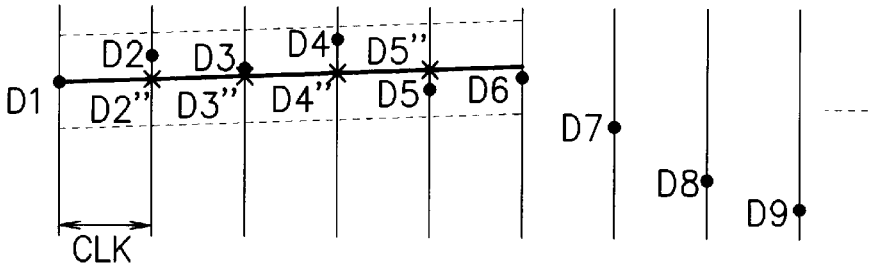

FIGS. 3A and 3B show examples of compression processing after the sorting processing shown in FIGS. 1A and 1B and FIGS. 2A to 2C. In the examples shown in FIGS. 3A and 3B, sampling points where an error between a data value on a straight line connecting data of two sampling points and a sample data value at the same sampling point as the data value on the straight line is up to a desired value are sequentially detected as sample points.

Then, discrete amplitude data at detected each sample point and timing data (the number of clocks) representing a time interval between each sample point are found, and a pair of the amplitude data and the timing data and pitch data representing a size of each window are transmitted or recorded as compression data.

The above-mentioned processing for detecting sample points will be described as follows more specifically. That is, sample data to be a reference and the other sample data whose time interval from there is within a predetermined range are selected out of sample data in each sorted sampling point. Then, sampling points where all errors between each data value on a straight line connecting the two sample data and each sample data value in the same sampling point as each data value on the straight line is up to a desired value, which are sampling points where a time interval is the longest within the above-mentioned predetermined range, are detected as sample points.

In FIGS. 3A and 3B, the horizontal axis represents time and the vertical axis represents amplitudes of sample data. D1 to D9 shown in FIGS. 3A and 3B are a part of the sample data obtained by the sorting processing. In this example of FIGS. 3A and 3B, sample data D1 is assumed to be reference sample data to be adopted first. In addition, a time interval between two sample data to be selected when sample points are detected is assumed to be in a range of six clocks at the maximum. Not that, if three bits or four bits are used as timing data, it is possible to set the time interval between two sample data to seven clocks or fifteen clocks at the maximum.

First, as shown in FIG. 3A, the reference sample data D1 and sample data D7 whose time interval from there is the maximum within a predetermined range are selected. Then, it is judged whether or not all of respective errors between data values D2', D3', D4', D5' and D6' of each sample points on a straight line connecting the two sample data and each sample data value D2, D3, D4, D5 and D6 in the same sampling point as each data value D2' to D6' of each sampling point on the straight line are up to a desired value.

That is, it is judged whether or not all errors between the data values D2', D3', D4', D5' and D6' on the straight line connecting the two sample data D1 and D7 and each sample data value D2, D3, D4, D5 and D6 corresponding to these values are within a range of desired values shown by a dot line. If this condition is met, the sampling point of the sample data D7 is detected as a sample point. However, in this example, since an error between the data value D4' on the straight line and the sample data value D4 corresponding to it exceeds the desired value, the sampling point of the sample data D7 is not adopted as a sample point at this point in time, and the processing is put forward.

Next, as shown in FIG. 3B, the sample data D6 whose time interval from the reference sample data D1 is one clock CLK shorter than the sample data D7 is selected. Then, it is judged whether or not all of respective errors between a data value D2", D3", D4" and D5" of each sampling point on a straight line connecting the two sample data D1 and D6 and each sample data value D2, D3, D4 and D5 in the same sampling point as each data value D2" to D5" on the straight line are up to a desired value.

Here, if all the errors are up to the desired value, a sampling point of the sample data D6 is detected as a sample point. In this example, since all the errors between each data value D2", D3", D4" and D5" on the straight line and each sample data value D2, D3, D4 and D5 are up to the desired value, this sampling point of the sample data D6 is detected as a sample point.

Further, if any of the conditions of errors that all the errors are up to the desired value with respect to the respective straight lines connected between D1 and D7, between D1 and D6, . . . , and between D1 and D3 is not met, a sampling point of the sample data D2 is detected as a sample point. That is, since other sample data does not exist between the sample data D1 and D2, it is unnecessary to perform the above-described error calculation for this section. Thus, if any of the conditions of errors is not met with respect to the respective straight lines connected in other sections, a position of the sample data D2 next to the sample data D1 that is currently used as a reference is detected as a sample point.

When one sample point is detected, the sample point is used as a reference sample data anew to perform the same processing as above within a range of six clocks from there. Consequently, a sampling point where all errors are up to a desired value within the range of six clocks from the sample data D6 and a time interval from the sample data D6 is the longest is detected as the next sample point.

Thereafter, a plurality of sample points are sequentially detected in the same manner. Then, a set of discrete amplitude data in the detected each sample point and timing data representing a time interval between each sample point by the number of clocks CLK is obtained as a part of compression data. In the above-described example, sets (D1, 5), (D6, *). . . of amplitude data (D1, D6, . . . ) in each sample point and timing data (5, *, . . . ) are obtained as a part of compression data (* indicates undecided in this example).

Note that, although the example is described here in which sampling points where a time interval between two sample data is the maximum within a predetermined range (sample data D1 and D7 in the example of FIGS. 3A and 3B) are selected first to start error judgment and processing is put forward in the direction of sequentially reducing the time interval, a direction of sample point search is not limited to this.

For example, sampling points where a time interval between two sample data is the minimum within a predetermined range (sample data D1 and D3 in the example of FIGS. 3A and 3B) may be selected first to start error judgment and processing may be put forward in the direction of sequentially extending the time interval. In addition, sampling points where a time interval between two sample data is around a center within a predetermined range (e.g., sample data D1 and D4 in the example of FIGS. 3A and 3B) may be selected to start error judgment.

In this way, according the compression system of this embodiment, only since amplitude data in discrete sample points extracted out of a large number of sampling points, timing data representing a time interval between sample points, or the like, pitch data representing a width of each window are obtained as compression data, a high compression ratio can be realized.

Moreover, if two or more sampling points satisfying conditions of errors concerning certain one reference data are detected within a predetermined range, sampling points where a time interval from the reference data is the longest are detected as sample points. In this way, a value of timing data can be controlled to be in predetermined bits and, at the same time, the number of sample points to be detected can be reduced as much as possible and a high compression ratio can be realized.

In addition, according to the compression system of this embodiment, the processing of the linear compression is applied to sample data that is sorted alternately for every two sections by applying the zigzag processing to original data instead of applying the processing of the linear compression as shown in FIGS. 3A and 3B to original data itself to be compressed. Therefore, a frequency of data to be an object of processing of linear compression can be reduced to approximately half, and a compression ratio can be further increased compared with the case in which the processing of the linear compression is applied to the original data itself.

That is, if the linear compression is applied to the original data itself, most of the sampling points are detected as sample points in a part where a frequency is high (data in which a sample data value changes relatively largely at sampling points proximate to each other). Thus, it is necessary to have amplitude data with a relatively large information amount as compression data for each sampling point.

As compared with the above, if the linear compression is applied to the data after sorting, sample points can be taken discretely even in a part where a frequency is originally high and the number of sample points to be detected can be reduced as much as possible. Therefore, the number of amplitude data in sample points that should be held as compression data can be reduced as much as possible, and a compression ratio can be increased.

On the other hand, as a basic principle of the decompression system according to this embodiment, although not specifically illustrated, amplitude data in each sample point of compression data generated as described above is, for example, linearly interpolated by a time interval shown by timing data. Then, the same windows as at the time of compression are set based on pitch data, and processing for re-sorting interpolation data alternately among the set windows of the same size is simply performed sequentially.

At the time of compression of this embodiment, points where an error is not increased even if linear interpolation is performed are detected as sample points taking into account, if two sample data is linearly interpolated, how much error another sample data between the two sample data generates with respect to the interpolated straight line. Therefore, only by simply interpolating amplitude data of each sample point obtained in this way, data of substantially the same waveform as the data after sorting as shown in FIG. 1B can be reproduced. Moreover, only by simply sorting data of FIG. 1B between each window, the original data before compression shown in FIG. 1A can be reproduced substantially perfectly.

Next, a detection method for a peak at the time of compression will be described. In the compression method of this embodiment, it is an important point to accurately detect peaks appearing substantially periodically as a premise for performing the zigzag processing. In this embodiment, it is judged sequentially whether or not respective sampling points (detection points of peaks) correspond to peaks while shifting a detection point by one clock.

In this case, a maximum value of data in a predetermined section (e.g., within 16 clocks) existing in front of a sampling point in a certain detection point inclusive (hereinafter referred to as a pre-maximum value) and a maximum value of data in a predetermined section existing behind the above-mentioned sampling point of the detection point (hereinafter referred to as a post-maximum value) are detected. Then, it is judged whether or not all the three values, the sample data in the present detection point value, the pre-maximum value and the post-maximum value, coincide with each other. If these values coincide with each other, the sampling points of the detection point are detected as peaks.

In this way, even if a sample data value of a certain sampling point is larger than a data value proximate to it and looks as if it is a peak at a glance, the sampling point is not detected as a peak if a larger data value exists in predetermined sections in front and behind the sampling point. Consequently, it becomes possible to accurately detect only a true peak having a data value extremely large compared with other peaks with respect to a signal in which a data value has a peak locally while oscillating up and down as in the case of FIG. 1A.

Note that, if a size of a predetermined section in which a maximum value is detected in front and behind a certain sampling point is set too small compared with a peak interval, a fine maximum point oscillating up and down is also detected as a peak. Conversely, if a size of a predetermined section is set too large compared with a peak interval, a true peak may not able to be detected. Thus, it is preferable to appropriately set a size of a predetermined section according to a peak interval to be estimated.

In addition, the decompression method may be arranged such that a pre-maximum value and a post-maximum value are detected within each section of 16 clocks that is set in front of and behind a present detection point and, at the same time, a second post-maximum value is detected in a larger section (e.g., within 32 clocks) set behind the present detection point and, if all four values, a sample data value in the present detection point, the pre-maximum value, the post-maximum value and the second post-maximum value, coincide with each other, a sampling point of the detection point is detected as a peak.

Further, the decompression system may be arranged such that a larger section is set in front of a present detection point, and a second pre-maximum value is detected instead of the second post-maximum value. In addition, the decompression system maybe arranged such that only the second post-maximum value is detected rather than both the post-maximum value and the second post-maximum value.

In the case in which sections of the same width are set in front and behind a detection point to detect a pre-maximum value and a post-maximum value, if the width of the sections is too small, excessive detection of a peak may occur, and if the width is too large, omission of detection may occur. However, in the case in which a section larger than usual is set in front of or behind a detection point to detect the second pre-maximum value or the second post-maximum value, candidates of peaks can be detected without omission in the section with the smaller width and peaks other than a true peak are to be filtered in the section with the larger width. Therefore, excessive detection and omission of detection of peaks can be prevented, and peaks can be detected more surely.

Figure 4:
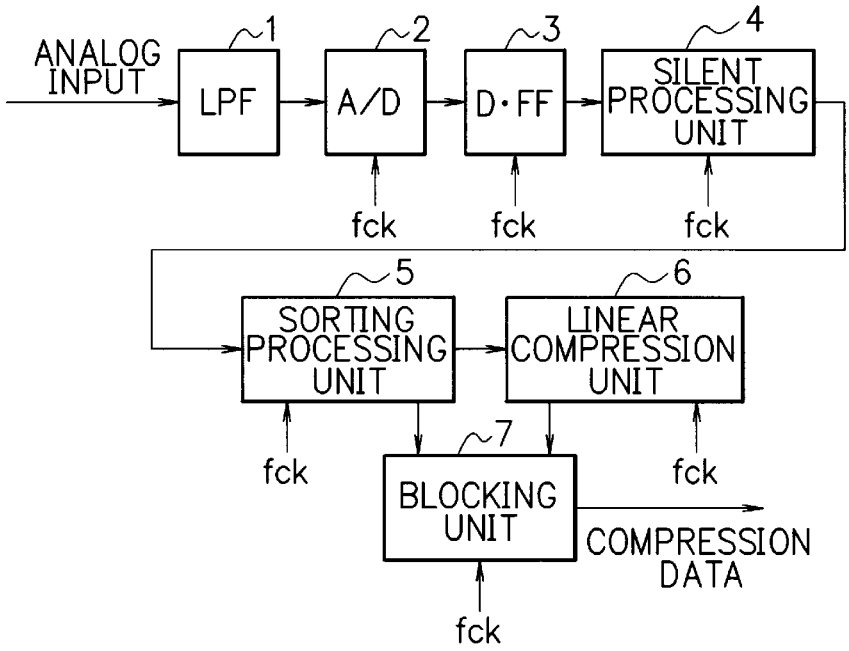
FIG. 4 is a block diagram showing an example of a functional structure of a compression apparatus according to this embodiment.

FIG. 4 is a block diagram showing an example of a functional structure of a compression apparatus according to this embodiment that realizes the above-mentioned compression system. The compression apparatus shown in FIG. 4 is applicable, for example, in the case in which an analog voice signal is inputted and compressed. Note that if a digital voice signal is inputted, a low-pass filter (LPF) 1 in a first stage and an A/D conversion unit 2 are unnecessary.

As shown in FIG. 4, the compression apparatus of this embodiment is constituted by an LPF 1, an A/D conversion unit 2, a D type flip flop 3, a silent processing unit 4, a sorting processing unit 5, a linear compression unit 6, and a blocking unit 7.

The LPF 1 is for removing noise of a high frequency component by applying filtering processing to an analog signal inputted as an object of compression in order to facilitate detection of a sample point.

The A/D conversion unit 2 converts an analog signal outputted from the LPF 1 into digital data. In doing so, the A/D conversion unit 2 executes A/D conversion processing in accordance with an input clock of a predetermined frequency fck (e.g., in the case of a human voice signal, 8 KHz) to be a reference. The D type flip flop 3 sequentially holds digital data at each sampling point outputted from the A/D conversion unit 2 in accordance with the input clock of the reference frequency fck.

The silence processing unit 4 performs processing for rounding an absolute value of each sample data held in the D type flip flop 3 by a predetermined value (e.g., "4"). In doing so, if an absolute value of sample data is smaller than the above-mentioned predetermined value, the silence processing unit 4 regards the sample data as silent and replaces a data value with "0" to output it. Consequently, fine noise components are removed and further increase of a compression ratio is realized.

As shown in FIGS. 1A and 1B and FIGS. 2A to 2C, the sorting processing unit 5 sequentially performs processing for, with respect to data having periodicity to be compressed, detecting peaks appearing substantially periodically, setting windows of the same size for every two sections according to periods of the peaks, and sorting sample data alternately among the set windows of the same size.

The linear compression unit 6 applies processing of linear compression as described in FIGS. 3A and 3B to the sample data sorted by the sorting processing unit 5. Consequently, the linear compression unit 6 detects discrete sample points out of each sampling point based on the reference frequency fck and finds amplitude data of sample data at each sample point and timing data representing a time interval between each sample point.

The blocking unit 7 appropriately blocks pitch data representing a width of each window set by the sorting processing unit 5 and timing data representing amplitude data at each sample point found by the linear compression unit 6 and a time interval between each sample point, and outputs the blocked data as compression data. The outputted compression data is, for example, transmitted to a transmission medium or recorded in a recording medium such as a nonvolatile memory.

Figure 5:
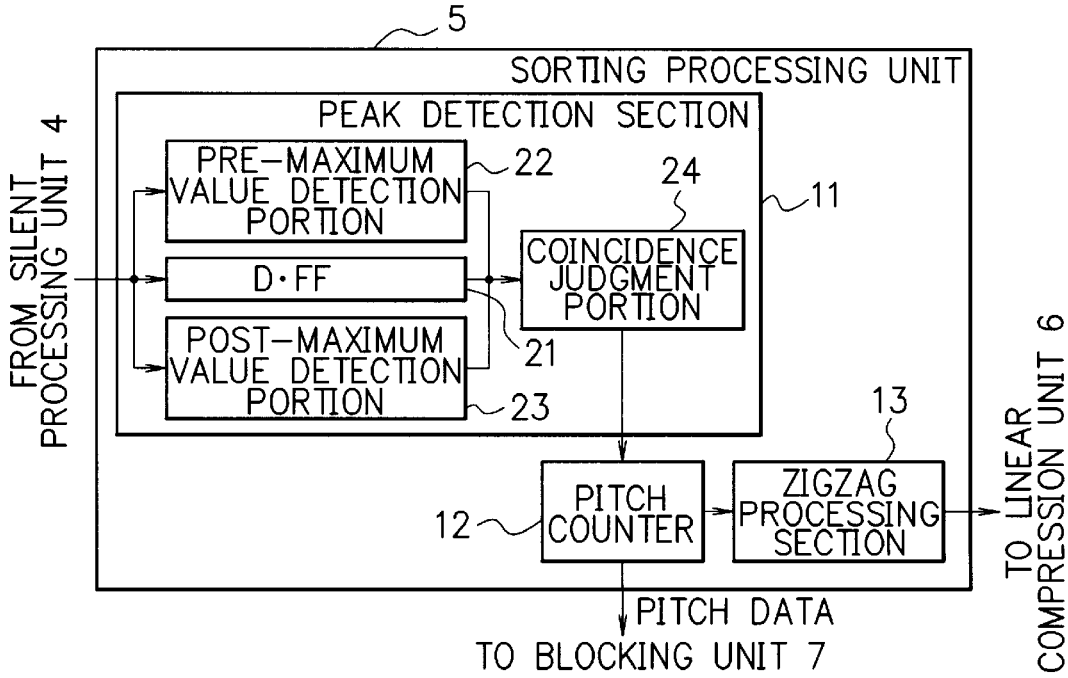
FIG. 5 is a block diagram showing a detailed example of a functional structure of a sorting processing unit.

FIG. 5 is a block diagram showing an example of a detailed functional structure of the above-mentioned sorting processing unit 5. As shown in FIG. 5, the sorting processing unit 5 is constituted by a peak detection section 11, a pitch counter 12, and a zigzag processing section 13. The peak detection section 11 is further provided with a D type flip flop 21, a pre-maximum value detection portion 22, a post-maximum value detection portion 23, and a coincidence judgment portion 24.

The peak detection section 11 performs processing for detecting a peak with respect to data to be compressed that is subjected to silent processing. In the internal structure of this peak detection section 11, the D type flip flop 21 holds sample data of a present detection point. The pre-maximum detection portion 22 detects a pre-maximum value within a predetermined section existing in front of a sampling point of a detection point inclusive. In addition, the post-maximum value detection portion 23 detects a post-maximum value within a predetermined section existing behind a sampling point of a detection point inclusive.

The coincidence judgment portion 24 judges whether or not a sample data value of a detection point held in the D type flip flop 21, the pre-maximum value detected by the pre-maximum value detection portion 22, and the post-maximum value detected by the post-maximum value detection portion 23, and detects a sampling point where these values coincide with each other as a peak.

The pitch counter 12 starts counting a clock CLK from a point in time when a certain peak is detected by the coincidence judgment portion 24, and returns a count value to an initial state at a point in time when the next peak is detected. Consequently, an interval between each peak (the number of clocks) is counted.

The zigzag processing section 13 sets windows according to the peak interval detected by the pitch counter 12, and performs processing for sorting sample data alternately among the set windows.

Figure 6:
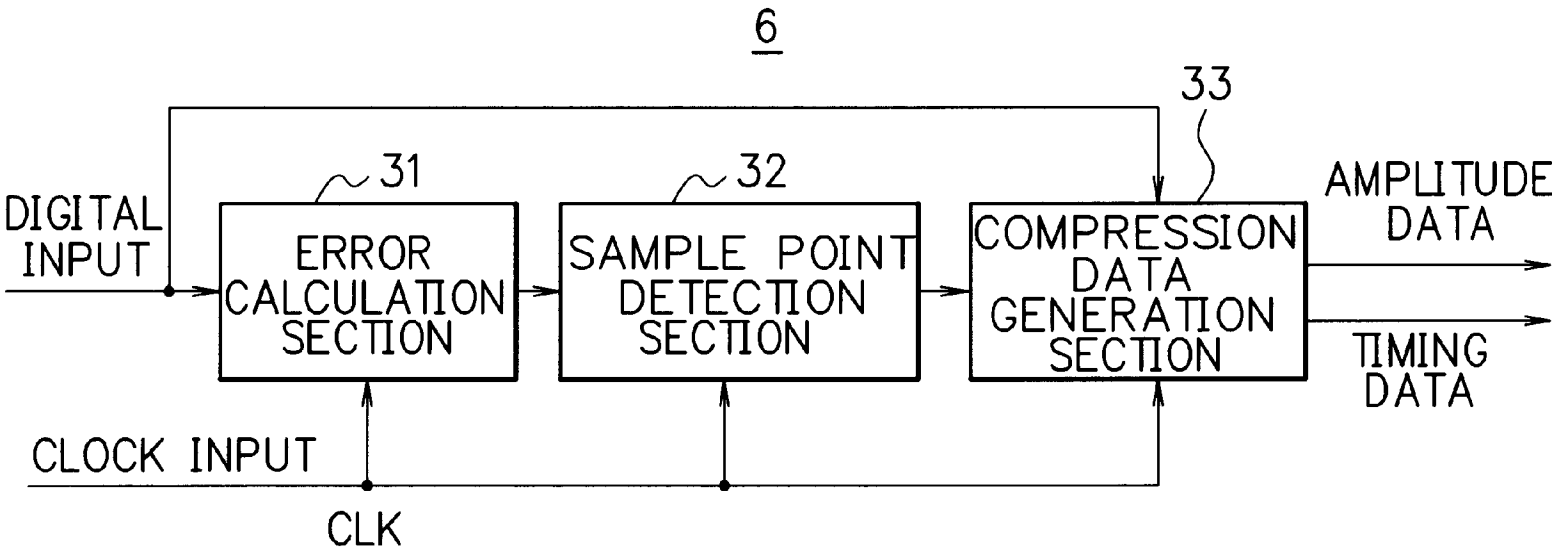
FIG. 6 is a block diagram showing an example of a detailed functional structure of a linear compression unit.

FIG. 6 is a block diagram showing an example of a detailed functional structure of the above-mentioned linear compression unit 6. As shown in FIG. 6, the linear compression unit 6 is constituted by an error calculation section 31, a sample point detection section 32, and a compression data generation section 33.

The error calculation section 31 selects a pair of sample data to be a reference and another sample data whose time interval from the reference is within a predetermined range (e.g., in the case in which timing data is three bits, within seven clocks; in the case of four bits, within fifteen clocks: in the following description, it is assumed that the time interval is within six clocks in conformity with FIG. 3) out of digital data after zigzag processing inputted from the sorting processing unit 5. Then, the error calculation section 31 calculates an error between each sample data value on a straight line connecting the selected two sample data and each sample data value at the same sampling point as each data value on the straight line, respectively.

The error calculation section 31 selects a plurality of pairs of reference sample data and another sample data that can be taken within a predetermined range from the reference sample data to perform the error calculation as described above. That is, in the case of the example of FIGS. 3A and 3B, the error calculation section 31 calculates an error at each sampling point in the case in which a straight line is connected between D1 to D7, an error at each sampling point in the case in which a straight line is connected between D1 to D6, and an error at each sampling point in the case in which a straight line is connected between D1 to D3, respectively.

In addition, the sample point detection section 32 detects, as a sample point, a sampling point that forms a straight line on which all errors at each sampling point calculated in the error calculation section 31 are equal to or less than a predetermined value, which is a sampling point where a time interval from the reference sample data is the longest. In the example of FIGS. 3A and 3B, as described above, if the sample data D1 is assumed to be a reference, the sampling point of D6 is detected as a sample point.

When one sample point is detected in this way, the error calculation section 31 and the sample point detection section 32 performs the same processing as the above within a range of six clocks from the sample point with the detected sample point as reference sample data anew. Thereafter, the error calculation section 31 and the sample point detection section 32 sequentially detect a plurality of sample points in the same manner.

Note that, as described with reference to FIGS. 3A and 3B, it is permissible to select sampling points from one where a time interval from the reference sample data is the longest in order to judge whether or not the sampling points meet the conditions of errors and, at the point in time when a sampling point meeting the conditions is found, detect it as a sample point.

The compression data generation section 33 finds a pair of discrete amplitude data at each sample point detected by the sample point detection section 32 and timing data representing a time interval between each sample point and obtains this pair of amplitude data and timing data as a part of compression data. The pair of amplitude data and timing data generated in this way is given to the blocking unit 7 in FIG. 4 and is appropriately blocked together with pitch data outputted from the pitch counter 12 of the sorting processing unit 5. Then, this blocked data is transmitted on a transmission path or recorded in a recording medium.

Next, a decompression apparatus corresponding to the compression apparatus described above will be described.

Figure 7:
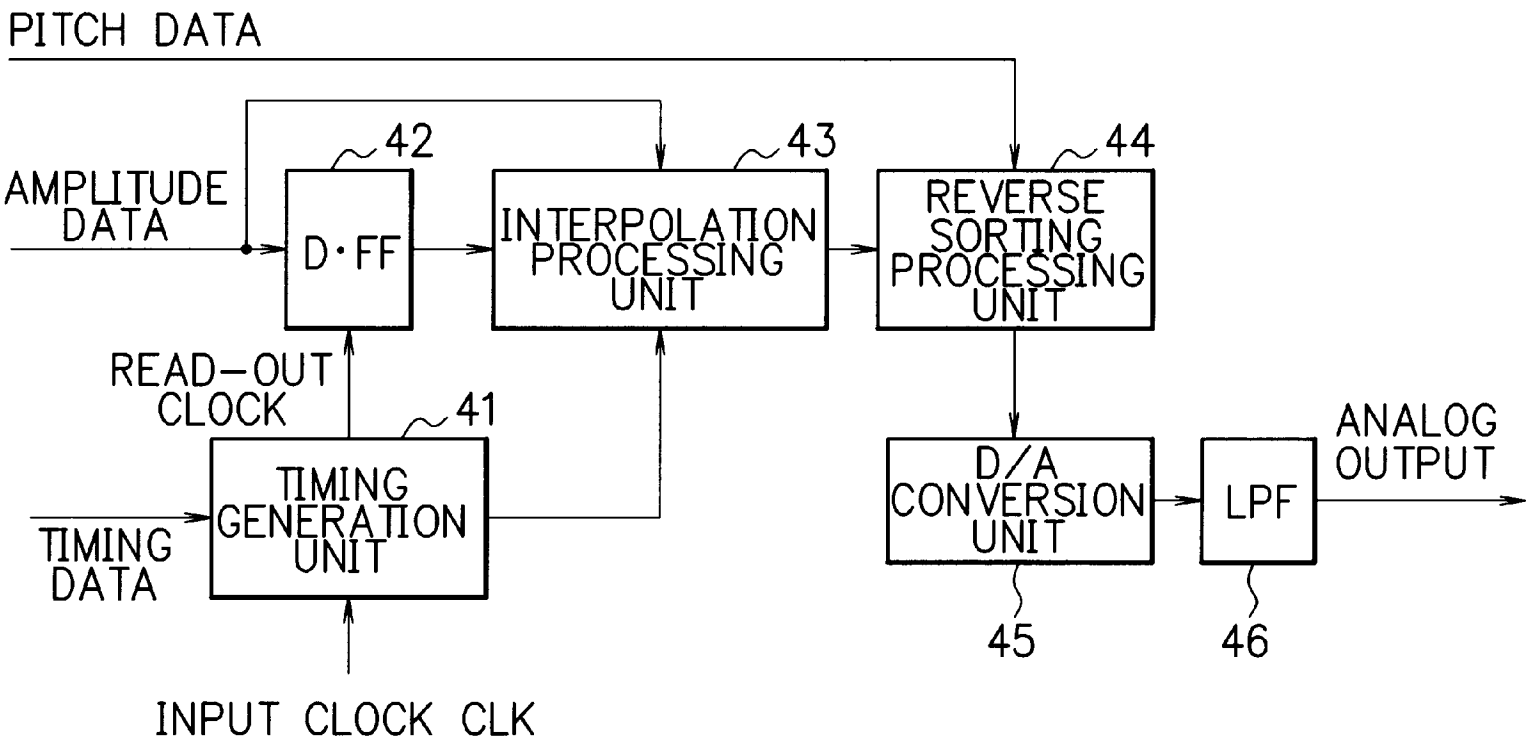
FIG. 7 is a block diagram showing an example of a functional structure of a decompression apparatus according to this embodiment.

FIG. 7 is a block diagram showing an example of a functional structure of the decompression apparatus according to this embodiment. As shown in FIG. 7, the decompression apparatus of this embodiment is constituted by a timing generation unit 41, a D type flip flop 42, an interpolation processing unit 43, a reverse sorting processing unit 44, a D/A conversion unit 45 and an LPF 46.

The timing generation unit 41 inputs timing data included in compression data and generates a read-out clock, which represents an undefined time interval that is the same as a time interval between sample points detected on the compression side, from an input clock CLK. The D type flip flop 42 sequentially captures and holds amplitude data included in the compression data at timing in accordance with the read-out clock generated by the timing generation unit 41 and outputs the amplitude data to the interpolation processing unit 43.

Inputted in this interpolation processing section 43 are amplitude data of an input/output stage of the D type flip flop 42, that is, amplitude data held in the D type flip flop 42 at timing of a certain read-out clock, and amplitude data that should be held in the D type flip flop 42 at timing of the next read-out clock (two amplitude data at continuous two sample points).

The interpolation processing unit 43 uses the two amplitude data inputted in this way and timing data inputted from the timing generation unit 41 to perform calculation for interpolating the two amplitude data by, for example, a straight line and generate digital interpolation data between each sample point. This interpolation processing unit 43 corresponds to data calculation means or data interpolation means of the present invention.

The reverse sorting processing unit 44 sets the same windows as at the time of compression based on the pitch data included in the compression data with respect to the interpolation data found by the interpolation processing unit 43 and sequentially performs processing for re-sorting the above-mentioned interpolation data among the set windows of the same size.

The D/A conversion unit 45 D/A converts the digital decompression data generated in this way into an analog signal. The LPF 46 applies filtering processing to the analog signal converted by the D/A conversion unit 45, thereby removing noises of a high-frequency component and outputs the analog signal as a reproduced analog signal.

As it is seen from this, on the decompression side, highly precise decompression data that is almost the same as original data before compression can be reproduced simply by performing extremely simple processing such as linear interpolation processing and reverse sorting processing.

The compression apparatus and the decompression apparatus according to this embodiment constituted as described above are constituted by, for example, a computer provided with a CPU or an MPU, an ROM, an RAM and the like. All or a part of their functions (e.g., the silent processing unit 4, the sorting processing unit 5, the linear compression unit 6 and the blocking unit 7 of the compression apparatus and the timing generation unit 41, the interpolation processing unit 43 and the reverse sorting processing unit 44 of the decompression apparatus, etc.) are realized by a program stored in the above-described ROM, RAM or the like operating.

In addition, it is permissible to constitute the compression apparatus and the decompression apparatus according to this embodiment constituted as described above in hardware manner by combining a logic circuit. Note that a hardware configuration for realizing the function of the linear compression unit 6 of the compression apparatus and the function of the interpolation processing unit 43 of the decompression apparatus are described in detail in Japanese Patent Application No. 2000-168625 that the applicant filed earlier. It is possible to apply this configuration described in Japanese Patent Application No. 2000-168625 to this embodiment.

As described above in detail, in this embodiment, since sampling points where, even if linear interpolation is performed at the time of decompression processing, an error between interpolated data and original data is not larger than a desired value are detected as sample points, and amplitude data of each sample point and timing data representing a time interval between each sample point are obtained as a part of compression data. Thus, it is possible to markedly improve a quality of data reproduced by decompression while realizing a high compression ratio.

In particular, according to the compression/decompression system of this embodiment, in interpolation data between sample points generated by linear interpolation, not only an error of its amplitude is small compared with original data before compression but also phase shift can be controlled to be very small. In the case in which voices are used as data to be compressed, phase shift affects a tone significantly. However, since this phase shift rarely occurs in this embodiment, a tone of the original data can be reproduced faithfully.

In addition, in this embodiment, the linear compression processing is applied to data, which is obtained by applying the zigzag processing to and sorting each sample data, instead of applying the linear compression processing to sample data itself in each sampling point. In this way, even if a signal with a high frequency is compressed, linear compression can be performed after converting a frequency to be low without damaging reproducibility to original data at all. Consequently, the number of sample points to be detected can be reduced as much as possible, and a higher compression ratio can be realized while maintaining a quality of data reproduced by decompression extremely well.

In addition, according to this embodiment, an analog signal or digital data to be compressed is directly compressed and decompressed on a time axis without time/frequency converting them. Thus, processing is not complicated and a structure can be simplified. Further, in the case in which compression data is transmitted from the compression side and reproduced in the decompression side, the compression data to be inputted can be sequentially processed and reproduced by very simple linear interpolation calculation on a time axis. Thus, a real time operation can be realized.

Note that, in the above-mentioned embodiment, the data as shown in FIG. 1B is obtained by applying the zigzag processing to the original data shown in FIG. 1A once, and the linear compression processing applied to the data. As compared with this, it is permissible to apply the zigzag processing to the data of FIG. 1B once or twice or more, and apply the linear compression processing to data obtained by the zigzag processing. In this way, linear compression can be performed after making a frequency lower, and the number of sample points to be detected can be further reduced to increase a compression ratio. Since the zigzag processing has 100% reproducibility how many times it is repeated, it is particularly effective in the case in which data with an extremely high frequency is compressed.

In addition, although windows of the same size are set between adjacent two sections to perform the zigzag processing in the above-mentioned embodiment, it is not always necessary to perform the zigzag processing between adjacent windows. Since correlation of data is strong between adjacent windows, it is preferable to perform the zigzag processing between the adjacent windows. However, it is permissible to perform the zigzag processing between, for example, every other windows.

In addition, although the zigzag processing is performed between two windows in the above-mentioned embodiment, it is permissible to perform the zigzag processing among three or more windows. For example, if the zigzag processing is performed among three windows, a frequency of original data can be reduced to as low as approximately 1/3, and a compression ratio can be further increased compared with the case in which the zigzag processing is performed between two windows.

In addition, although voice data of human speech is used as data to be compressed in the above-mentioned embodiment, data to be compressed is not limited to this. The compression/decompression system can be applied to any data as long as the data has periodicity. For example, the compression/decompression system can be applied to voice data of music in the same manner. In addition, a signal may not be a signal in which peaks appears substantially periodically as long as it has periodicity and its period can be recognized. Further, in the case in which a signal having a completely identical period is compressed, windows of a fixed length can be set in advance without performing peak detection or the like, and processing load can be reduced so much more for this.

In addition, the case in which the linear compression processing as shown in FIGS. 3A and 3B is performed is described as compression processing after the zigzag processing. However, this is simply an example. That is, the compression/decompression system can be applied to any compression processing as long as it has dependency on frequency in that a compression ratio decreases in a high-frequency region. For example, the compression/decompression system can be applied to compression processing disclosed in Japanese Patent Application No. 11-241885, Japanese Patent Application No. 11-312878, Japanese Patent Application No. 2000-33864, and the like.

The compression processing will be described briefly as follows. The compression processing disclosed in Japanese Patent Application No. 11-241885 detects points where a differential absolute value is equal to or less than a predetermined value including "0" as sample points out of data to be compressed, and obtains a pair of amplitude data of each sample point and timing data representing a time interval between each sample point as compression data.

In addition, the compression processing disclosed in Japanese Patent Application No. 11-312878 detects positions where a differential absolute value is small compared with positions in front of or behind the positions, that is, points where a differential absolute value is minimum as sample points out of data to be compressed, and obtains a pair of amplitude data of each sample point and timing data representing a time interval between each sample point as compression data.

In addition, the compression processing disclosed in Japanese Patent Application No. 2000-33864 detects points where polarity of a differential value changes as sample points out of data to be compressed, and obtains a pair of amplitude data of each sample point and timing data representing a time interval between each sample point as compression data.

In addition, in the above-mentioned embodiment, in the linear compression processing the number of bits of timing data is assumed to be three bits, and a straight line is drawn within a range of six clocks from reference sample data to perform error judgment. However, the present invention is not limited to this example. For example, a predetermined range at the time when the error judgment is performed may be seven clocks. Further, the number of bits of timing data may be four bits or more, and the predetermined range at the time when a straight line is drawn from the reference sample data to perform error judgment may be eight clocks or more. In this way, it is possible to further increase a compression ratio. In addition, the number of bits of timing data or the predetermined range at the time when error judgment is performed may be able to be set arbitrarily as a parameter.

In addition, processing may be performed without setting a limitation of within a predetermined range to a time interval between two data that is selected when discrete sample points are detected. In this case, sampling points immediately preceding a sampling point where an error exceeds a desired value are sequentially detected as sample pints. In such a case, it becomes possible to take an interval between sample points as long as possible to reduce the number of sample points to be detected as much as possible, and a compression ratio can be further increased.

In addition, as an allowable value of an error, it is possible to use, for example, 64, 128, 256, 384, 512, and the like. If the allowable value of an error is decreased, compression/decompression that attaches importance to reproducibility of a reproduced analog signal can be realized. Further, if the allowable value of an error is increased, compression/decompression that attaches importance to a compression ratio can be realized. Note that the allowable value of an error may be set arbitrarily as a parameter.

In addition, it is permissible to make an allowable value of an error as a function of a data amplitude and, for example, make the allowable value of an error large at a point where an amplitude is large and make the allowable value of an error small at a point where an amplitude is small. An error is not conspicuous even if it becomes large to some extent and does not affect a sound quality significantly at a point where an amplitude is large. Therefore, if the allowable value of an error is dynamically changed as a function of a data amplitude as described above, it is possible to further increase a compression ratio while keeping a sound quality of reproduced data extremely well.

In addition, it is permissible to make an allowable value of an error as a function of a frequency and, for example, make the allowable value of an error large at a point where a frequency is high and make the allowable value of an error small at a point where a frequency is low. The number of sample points to be detected increases if the allowable value of an error is small and a high compression ratio may not be able to be realized in a part where a frequency is high in signals inputted in a series as objects of compression, that is, a part where a sample data value changes relatively largely in a proximate sampling point. However, it is possible to further increase a compression ratio while keeping a sound quality of reproduced data extremely well as a whole by making the allowable value of an error large dynamically in a part where a frequency is high.

It is needless to mention that an allowable value of an error may be changed dynamically as a function of both of a data amplitude and a frequency.

In addition, although the example in which digital data is linearly interpolated in the interpolation processing unit 43 on the decompression side is described in the above-mentioned embodiment, interpolation calculation is not limited to this example. For example, curved line interpolation processing using a predetermined sampling function may be performed. Further, the interpolation processing described in Japanese Patent Application No. 11-173245 that the applicant filed earlier may be performed. In this case, since a waveform extremely close to analog can be obtained by interpolation itself, it is possible to make the D/A conversion unit 45 and the LPF 46 at the later stage unnecessary.

Further, it is possible to realize the compression/decompression method according to this embodiment described above by any of the hardware configuration, DSP and software as described above. For example, if it is realized by software, the compression apparatus and the decompression apparatus of this embodiment are actually constituted by a CPU or an MPU, an RAM, an ROM and the like of a computer and is realized by a program stored in the RAM or the ROM operating.

Therefore, the compression apparatus and the decompression apparatus can be realized by recording a program, which causes the computer to operate so as to perform the function of the above-mentioned embodiment in a recording medium such as a CD-ROM, and causing the computer to read the program. As a recording medium for recording the above-mentioned program, a floppy disk, a hard disk, a magnetic tape, an optical disk, a magneto-optical disk, a DVD, a nonvolatile memory card, or the like can be used other than the CD-ROM. In addition, the compression apparatus and the decompression apparatus can be realized by downloading the above-mentioned program in the computer via a network such as the Internet.

In addition, in the case in which not only the function of the above-described embodiment is realized by the computer executing the supplied program but also the function of the above-described embodiment is realized by the program cooperating with an OS (operating system) running on the computer, other application software, or the like, and the case in which the function of the above-described embodiment is realized by all or a part of processing of the supplied program being performed by a function extending board or a function extending unit of the computer, such a program is included in the embodiment of the present invention.

Besides, each embodiment described above only shows an example of materialization in implementing the present invention, and a technical scope of the present invention should not be interpreted restrictively by the embodiment. That is, the present invention can be implemented in various forms without departing from a spirit or a main characteristic thereof.

As described above in detail, according to the present invention, a new compression/decompression system can be provided which has a simple structure, short processing time for compression/decompression, and is capable of realizing both of a high compression ratio and improvement of a quality of reproduced data.

That is, according to the present invention, with respect to data having periodicity to be compressed, processing for sorting sample data alternately among windows that are set according to a period of the data is performed, and compression processing is applied to data obtained by the processing. Consequently, a frequency of data having periodicity can be replaced with a lower frequency without damaging reproducibility to original data at all, and the compression processing can be applied to data of the replaced low frequency. Therefore, by applying the compression/decompression system to compression processing having dependency on a frequency in that a compression ratio decreases in a high-frequency region, a compression ratio can be improved while keeping reproducibility to original data extremely well even if the compression processing itself is not changed at all.

In addition, according to the present invention, only amplitude data of sample points where, even if linear interpolation is performed at the time of decompression processing, an error between the interpolated data and original data is not large, timing data representing a time interval between each sample point, and pitch data representing a width of each window among a large number of sample data obtained by the above-described sorting are obtained as compression data. Thus, a high compression ratio can be realized while keeping data reproduced by decompression high quality.

In particular, in the present invention, processing of error judgment is applied to data generated by sorting each sample data among windows rather than applying the above-described error judgment to original data itself to be compressed to compress data, whereby, even in the case in which a signal with a high frequency is compressed, the processing of error judgment can be performed after substantially decreasing the frequency without damaging reproducibility of the original data at all, and the number of sample points to be detected can be reduced as much as possible to realize a higher compression ratio.

Moreover, according to the present invention, in compressing a signal on a time axis, processing can be performed as the signal is on the time axis without performing processing on a frequency axis by performing time/frequency conversion. In addition, in decompressing data compressed in this way, processing can be performed as the data is on the time axis. In particular, on the decompression side, highly precise decompression data that is almost the same as original data before compression can be reproduced simply by performing extremely simple processing such as interpolation processing and reverse sorting.

Further, according to the peak detection method of the present invention, with respect to a signal in which a data value has peaks locally while oscillating up and down, only a true peak having a data value which is extremely large compared with other peaks can be accurately detected.

INDUSTRIAL APPLICABILITY

The present invention is useful in providing a completely new compression/decompression system for realizing both of improvement of a compression ratio and improvement of a quality of reproduced data and, further, a completely new compression/decompression system that simplifies compression/decompression processing of a signal to allow reduction of processing time and to allow simplification of a structure for realizing this.

What is claimed is:

1. A compression method, comprising:

setting, with respect to data having periodicity to be compressed, windows of the same size for every plurality of sections according to a period of the data, sequentially performing processing for sorting sample data alternately among the set windows of the same size, and applying compression processing to data obtained by the sorting processing.

2. The compression method according to claim 1, further comprising:

setting, with respect to said data having periodicity to be compressed, windows of the same size for every two sections according to said period, and sequentially performing processing for sorting sample data alternately between two windows for every two sections.

3. The compression method according to claim 1, further comprising:

setting, with respect to said data having periodicity to be compressed, windows of the same size for every plurality of sections according to said period, sequentially performing processing for sorting sample data alternately among the set windows of the same size, and further setting, with respect to data obtained by the processing, windows of the same size for every plurality of sections according to the period of the data, and performing processing for sorting sample data alternately among the set windows of the same size, and applying compression processing to data obtained by the processing.

4. The compression method according to claim 1, further comprising:

detecting, with respect to said data having periodicity to be compressed, peaks appearing substantially periodically, and setting said windows according to an interval of the detected peaks.

5. The compression method according to claim 4, further comprising:

detecting a maximum value of data in a first section existing before a certain sampling point inclusive (pre-maximum value), detecting a maximum value of data in a second section existing after said certain sampling point inclusive (post-maximum value), and, if a data value of said certain sampling point, said pre-maximum value and said post-maximum value are coincide with each other, detecting said certain sampling point as said peak.

6. The compression method according to claim 5, wherein said first section and said second section are the same size.

7. The compression method according to claim 5, wherein said first section is larger than said second section or said second section is larger than said first section.

8. The compression method according to claim 4, further comprising:

detecting a maximum value of data in a first section existing before a certain sampling point inclusive (pre-maximum value), detecting a maximum value of data in a second section, which is the same size as said first section, existing after said certain sampling point inclusive (first post-maximum value), and detecting a maximum value of data in a third section, which is larger than said second section, existing after said certain sampling point inclusive (second post-maximum value), and, if a data value of said certain sampling point, said pre-maximum value, said first post-maximum value and said second post-maximum value are coincide with each other, detecting said certain sampling point as said peak.

9. The compression method according to claim 4, further comprising:

adopting every other intervals of said plurality of detected peaks to set windows of sizes corresponding to the intervals for every two sections, and sequentially performing processing for sorting sample data alternately between two windows for every two sections.

10. A method for decompression processing of compression data generated in accordance with the compression method of claim 1, the decompression method comprising:

setting windows for data obtained by the decompression processing to be a same size as windows used in the compression method, and sequentially performing processing for sorting said data alternately among the set windows of the same size, and obtaining decompression data.

11. A decompression program for causing a computer to execute processing procedures of said decompression method according to claim 10.

12. A computer readable recording medium having recorded thereon a program for causing a computer to execute processing procedures of said decompression method according to claim 10.

13. A compression program for causing a computer to execute processing procedures of said compression method according to claim 1.

14. A computer readable recording medium having recorded thereon a program for causing a computer to execute processing procedures of said compression method according to claim 1.

15. A compression method, comprising:

setting, with respect to data having periodicity to be compressed, windows of the same size for every plurality of sections according to a period of the data, sequentially performing processing for sorting sample data alternately among the set windows of the same size, and applying processing for sequentially detecting sampling points where, when data of two sampling points are subjected to linear interpolation, an error between the interpolated data and original data is equal to or less than a desired value, as sample points of the compression data to data obtained by the sorting processing.

16. The compression method according to claim 15, wherein said compression data includes:

pitch data representing a size of each window, amplitude data of each sample point, and timing data representing a time interval between said each sample point.

17. A decompression method, for decompressing compression data generated in accordance with the compression method of claim 15, the method comprising:

using amplitude data of each sample point included in the generated compression data and using timing data representing a time interval between said each sample point to find interpolation data for interpolating amplitude data having the time interval indicated by said timing data;

setting the same windows as claim 15 for the interpolation data obtained in this way;

sequentially performing processing for sorting said interpolation data alternately among the set windows of the same size; and obtaining decompression data.

18. A compression method, comprising:

setting, with respect to data having periodicity to be compressed, windows of the same size for every plurality of sections according to a period of the data, sequentially performing processing for sorting sample data alternately among the set windows of the same size, and applying processing for sequentially detecting sampling points where an error between a data value on a straight line connecting data of two sampling points and a sample data value in the same sampling point as the data value on the straight line is equal to or less than a desired value as sample points of the compression data to data obtained by the sorting processing.

19. A compression method, comprising:

setting, with respect to data having periodicity to be compressed, windows of the same size for every plurality of sections according to a period of the data, sequentially performing processing for sorting sample data alternately among the set windows of the same size, and applying processing for sequentially detecting sampling points where all errors between a data value on a straight line connecting data of two sampling points and each sample data value in the same sampling point as each data value on the straight line are equal to or less than a desired value, which are sampling points where a time interval between said two sampling points is the longest within a predetermined range, as sample points of the compression data to data obtained by the sorting processing.

20. A compression method, comprising:

setting, with respect to data having periodicity to be compressed, windows of the same size for every plurality of sections according to a period of the data, sequentially performing processing for sorting sample data alternately among the set windows of the same size, and applying processing for sequentially detecting sampling points where an error between a data value on a straight line connecting data of two sampling points and a sample data value in the same sampling point as the data value on the straight line is equal to or less than a desired value, which are sampling points immediately preceding sampling points where said error exceeds said desired value, as sample points of the compression data to data obtained by the sorting processing.

21. A compression apparatus, comprising:

sorting means for, with respect to data having periodicity to be compressed, setting windows of the same size for every plurality of sections according to a period of the data;

means for sequentially performing processing for sorting sample data alternately among the set windows of the same size; and compressing means for applying compression processing to data obtained by said sorting means.

22. The compression apparatus according to claim 21, wherein said sorting means comprises:

peak detection means for detecting peaks appearing substantially at a same periodicity with respect to said data having periodicity to be compressed; and zigzag processing means for setting said windows according to an interval of peaks detected by said peak detection means and sequentially performing processing for sorting sample data alternately among the set windows of the same size.

23. The compression apparatus according to claim 22, wherein said peak detection means detects a maximum value of data in a first section existing before a certain sampling point inclusive (pre-maximum value) and a maximum value of data in a second section existing after said certain sampling point inclusive (post-maximum value), and, if a data value of said certain sampling point, said pre-maximum value, and said post-maximum value are coincident with each other, said peak detection means detects said certain sampling point as said peak.

24. The compression apparatus according to claim 22, wherein said zigzag processing means adopts every other interval of said plurality of peaks detected by said peak detection means to set windows of sizes corresponding to the intervals for every two sections, wherein said zigzag processing means sequentially performs processing for sorting sample data alternately between two windows for every two sections.

25. A decompression apparatus, comprising:

amplitude data calculation means for applying decompression processing corresponding to said compression processing of compression data generated by said compression apparatus according to claim 21, said amplitude data calculation means finding amplitude data of each sampling point; and reverse sorting means for setting the same windows as claim 21 for amplitude data found by said amplitude data calculation means and sequentially performing processing for sorting said amplitude data alternately among the set windows of the same size, wherein said reverse sorting means obtains decompression data.

26. A decompression program for causing a computer to function as each means according to claim 25.

27. A computer readable recording medium having recorded thereon a program for causing a computer to function as each means according to claim 25.

28. A compression program for causing a computer to function as each means according to claim 21.

29. A computer readable recording medium having recorded thereon a program for causing a computer to function as each means according to claim 21.

30. A compression apparatus, comprising:

sorting means for, with respect to data having periodicity to be compressed, setting windows of the same size for every plurality of sections according to a period of the data, processing means for sequentially performing processing for sorting sample data alternately among the set windows of the same size; and linear compression means for applying processing for sequentially detecting sampling points where, when data of two sampling points are subjected to linear interpolation, an error between the interpolated data and original data is equal to or less than a desired value, as sample points of the compression data to data obtained by said sorting means.

31. The compression apparatus according to claim 30, wherein said linear compression means applies processing for sequentially detecting sampling points where all errors between each data value on a straight line connecting data of said two sampling points and each sample data value in the same sampling point as each data value on the straight line are equal to or less than a desired value, which are sampling points where a time interval between said two sampling points is the longest within a predetermined range, as sample points of said compression data to data obtained by said sorting means.

32. The compression apparatus according to claim 30, wherein said linear compression means applies pro sing for sequentially detects sampling points where an error between a data value on a straight line connecting data of said two sampling points and a sample data value in the same sampling point as the data value on the straight line is equal to or less than a desired value, which are sampling points immediately preceding sampling points where said error exceeds said desired value, as sample points of said compression data to data obtained by said sorting means.

33. The compression apparatus according to claim 30, wherein said compression data includes:

pitch data representing a size of each window, amplitude data of each sample point, and timing data representing a time interval between said each sample point.

34. A decompression apparatus, comprising:

data interpolation means for using amplitude data of each sample point included in compression data generated by said compression apparatus according to claim 30, said data interpolation means using timing data representing a time interval between said each sample point to find interpolation data for interpolating amplitude data having the time interval indicated by said timing data; and reverse sorting means for setting the same windows as claim 30 for interpolation data found by said data interpolation means, said reverse sorting means sequentially performing processing for sorting said interpolation data alternately among the set windows of the same size, and obtaining decompression data.

35. A compression/decompression system, comprising:

on a compression side, with respect to data having periodicity to be compressed, means for setting windows of the same size for every plurality of sections according to a period of the data, means for sequentially performing processing for sorting sample data alternately among the set windows of the same size, and means for applying compression processing to data obtained by the processing and obtaining compression data, and on a decompression side, means for applying decompression processing corresponding to said compression processing to said compression data, means for setting windows of the same size for said every plurality of sections for data obtained by the processing, and means for sequentially performing processing for sorting said data alternately among the set windows of the same size and obtaining decompression data.

36. A compression/decompression system, comprising:

on a compression side, with respect to data having periodicity to be compressed, means for setting windows of the same size for every plurality of sections according to a period of the data, means for sequentially performing processing for sorting sample data alternately among the set windows of the same size, and means for applying processing for sequentially detecting sampling points where, at the time when linear interpolation is applied to data of two sampling points, an error between interpolated data and original data is equal to or less than a desired value as sample points to data obtained by the processing, said means for applying processing obtaining amplitude data of each sample point and timing data representing a time interval between said each sample point as compression data, and on a decompression side, means for using amplitude data of each sample point included in said compression data and timing data representing a time interval between said each sample point to find interpolation data for interpolating amplitude data having a time interval indicated by said timing data and, means for setting windows of the same size for said every plurality of sections based on said pitch data and sequentially performing processing for sorting said interpolation data alternately among the set windows of the same size, and means for obtaining decompression data.

* * * * *